US010829269B2

(12) United States Patent
Gonitianer et al.

(10) Patent No.: US 10,829,269 B2
(45) Date of Patent: Nov. 10, 2020

(54) STACKABLE SYSTEM CONTAINER

(71) Applicant: BS Systems GmbH & Co. KG, Zusmarshausen (DE)

(72) Inventors: Reiner Gonitianer, Dillingen (DE); Jan Kögel, Zusmarshausen (DE)

(73) Assignee: BS Systems GmbH & Co. KG, Zusmarshausen (DE)

( * ) Notice: Subject to any disclaimer, the term of this patent is extended or adjusted under 35 U.S.C. 154(b) by 0 days.

(21) Appl. No.: 16/317,175

(22) PCT Filed: Apr. 11, 2017

(86) PCT No.: PCT/EP2017/058672
§ 371 (c)(1),
(2) Date: Jan. 11, 2019

(87) PCT Pub. No.: WO2018/010859
PCT Pub. Date: Jan. 18, 2018

(65) Prior Publication Data

US 2019/0315515 A1 Oct. 17, 2019

(30) Foreign Application Priority Data

Jul. 13, 2016 (DE) ..... 10 2016 112 853

(51) Int. Cl.
*B65D 21/032* (2006.01)
*B65D 21/02* (2006.01)
*B25H 3/02* (2006.01)

(52) U.S. Cl.
CPC ..... *B65D 21/0217* (2013.01); *B25H 3/02* (2013.01)

(58) Field of Classification Search
CPC ..... B25H 3/02; B25H 3/021; B25H 3/022; B65D 21/0217; B65D 21/0222; B65D 21/0223; B65D 21/023; B65D 21/0228
See application file for complete search history.

(56) References Cited

U.S. PATENT DOCUMENTS 4,643,494 A 2/1987 Marleau
4,671,943 A 6/1987 Wahlquist
(Continued)

FOREIGN PATENT DOCUMENTS

DE 7244356 U 5/1974
DE 4009960 A1 10/1990
(Continued)

OTHER PUBLICATIONS

International Search Report and Written Opinion for PCT/EP2017/058672 filed Apr. 11, 2017.
(Continued)

*Primary Examiner* — Stephen J Castellano
(74) *Attorney, Agent, or Firm* — Paul D. Bianco; Stephen Bongini; Fleit Intellectual Property Law

(57) ABSTRACT

A stackable system container includes a base part and a cover part fastened to the base part, and has at least two coupling elements which protrude upward beyond a top side of the system container and which each have at least one recess for the engagement of a coupling device of an identical system container arranged thereabove and which are arranged at opposite ends of the top side of the system container. To permit both dimensionally stable and connected stacking of structurally identical system containers and also modular stacking of different system containers, the coupling elements are fastened pivotably to the top side of the system container such that, in a pivoted-in position, they do not protrude beyond the top side of the system container.

19 Claims, 5 Drawing Sheets

(56) References Cited

U.S. PATENT DOCUMENTS

| | | | |
|---|---|---|---|
| D292,634 | S | 11/1987 | Chabot |
| 4,820,499 | A | 4/1989 | Taschner |
| 5,101,969 | A | 4/1992 | Umiker |
| D340,353 | S | 10/1993 | Benarrouch |
| 5,379,887 | A | 1/1995 | Conley, Jr. |
| D355,764 | S | 2/1995 | Apps |
| D356,211 | S | 3/1995 | Apps |
| D356,679 | S | 3/1995 | Apps |
| D360,757 | S | 8/1995 | Snetting |
| D361,663 | S | 8/1995 | Kalin |
| 5,445,273 | A | 8/1995 | Apps |
| 5,495,945 | A | 3/1996 | Apps |
| 5,890,613 | A | 4/1999 | Williams |
| D416,682 | S | 11/1999 | Tanji |
| 5,979,654 | A | 11/1999 | Apps |
| 6,082,539 | A | 7/2000 | Lee |
| D439,408 | S | 3/2001 | Gibson |
| D446,015 | S | 8/2001 | Apps |
| D448,567 | S | 10/2001 | Buss |
| D452,613 | S | 1/2002 | Hammett |
| D462,522 | S | 9/2002 | Apps |
| D470,658 | S | 2/2003 | Chunn |
| D478,421 | S | 8/2003 | Overholt et al. |
| D483,946 | S | 12/2003 | Koefelda |
| D487,634 | S | 3/2004 | Apps et al. |
| 6,874,634 | B2 | 4/2005 | Riley |
| 6,880,869 | B2 | 4/2005 | Schainholz |
| 6,889,838 | B2 | 5/2005 | Meier et al. |
| 7,000,287 | B2 | 2/2006 | Valentini |
| D520,237 | S | 5/2006 | Cheng |
| D520,734 | S | 5/2006 | Henning et al. |
| D524,651 | S | 7/2006 | Perret |
| D539,541 | S | 4/2007 | Stahl |
| D542,529 | S | 5/2007 | Peart et al. |
| D557,011 | S | 12/2007 | Fernandez et al. |
| D572,479 | S | 7/2008 | Buck |
| D595,958 | S | 7/2009 | Twig |
| D598,684 | S | 8/2009 | Stahl |
| 7,573,385 | B2 | 8/2009 | Tonelli |
| D600,015 | S | 9/2009 | Wenchel |
| D601,797 | S | 10/2009 | Wenchel |
| D608,094 | S | 1/2010 | Concari |
| D616,200 | S | 5/2010 | Riedel et al. |
| D620,255 | S | 7/2010 | Chang |
| D630,435 | S | 1/2011 | Brunner |
| 8,061,492 | B2 | 11/2011 | Riedel et al. |
| 8,186,534 | B2 | 5/2012 | Apps |
| D668,867 | S | 10/2012 | Yamamot |
| D688,869 | S | 9/2013 | Lindstrom |
| 8,522,967 | B2 | 9/2013 | Lindstrom |
| 8,590,704 | B2 | 11/2013 | Koenig et al. |
| 8,677,661 | B2 | 3/2014 | Michels et al. |
| D704,442 | S | 5/2014 | Chen |
| D719,352 | S | 12/2014 | Shitrit |
| D738,106 | S | 9/2015 | Shitrit |
| 9,131,770 | B2 | 9/2015 | Stegherr |
| D750,890 | S | 3/2016 | Quehl |
| D757,435 | S | 5/2016 | Damberg |
| D759,975 | S | 6/2016 | Zozin |
| D785,938 | S | 5/2017 | Ou |
| D790,221 | S | 6/2017 | Yahav |
| D792,708 | S | 7/2017 | Tazawa |
| D798,053 | S | 9/2017 | Shitrit |
| D801,685 | S | 11/2017 | Meng |
| D808,653 | S | 1/2018 | Rayeski |
| D811,084 | S | 2/2018 | Ballou |
| RE47,022 | E | 9/2018 | Sosnovsky |
| D833,743 | S | 11/2018 | Tonelli |
| D841,981 | S | 3/2019 | Kogel |
| D841,982 | S | 3/2019 | Kogel |
| D841,983 | S | 3/2019 | Wang |
| 10,405,626 | B2 | 9/2019 | Gonitianer et al. |
| D872,471 | S | 1/2020 | Zhao |
| D873,004 | S | 1/2020 | Shpitzer |
| D882,952 | S | 5/2020 | Austin |
| 10,703,534 | B2 | 6/2020 | Brunner |
| 10,710,770 | B2 | 7/2020 | Kogel |
| 2003/0094392 | A1 | 5/2003 | Meier et al. |
| 2003/0102970 | A1 | 6/2003 | Creel et al. |
| 2006/0049640 | A1 | 3/2006 | Lee |
| 2006/0170558 | A1 | 8/2006 | Tonelli |
| 2008/0067091 | A1 | 3/2008 | Chang |
| 2008/0251396 | A1 | 10/2008 | Oh |
| 2009/0236255 | A1 | 9/2009 | Piacenza et al. |
| 2011/0121695 | A1 | 5/2011 | Purdy |
| 2011/0139666 | A1 | 6/2011 | Sosnovsky et al. |
| 2011/0147256 | A1 | 6/2011 | Atherton et al. |
| 2011/0186397 | A1 | 8/2011 | Sheikh |
| 2011/0233096 | A1 | 9/2011 | Michels et al. |
| 2014/0062281 | A1 | 3/2014 | Stegherr |
| 2014/0262885 | A1 | 9/2014 | Green et al. |
| 2016/0008972 | A1 | 1/2016 | Chen |
| 2016/0144500 | A1 | 5/2016 | Chen |
| 2016/0213115 | A1 | 7/2016 | Gonitianer et al. |
| 2017/0318927 | A1 | 11/2017 | Kraus et al. |
| 2018/0220758 | A1 | 8/2018 | Burchia |
| 2019/0291922 | A1 | 9/2019 | Gonitianer |
| 2019/0308772 | A1 | 10/2019 | Gonitianer |
| 2019/0315515 | A1 | 10/2019 | Gonitianer et al. |

FOREIGN PATENT DOCUMENTS

| | | | |
|---|---|---|---|
| DE | 4107267 | A1 | 9/1992 |
| DE | 9314298 | U1 | 2/1994 |
| DE | 29723812 | U1 | 4/1999 |
| DE | 102006002475 | | 7/2006 |
| DE | 202005015040 | | 8/2006 |
| DE | 10 2007 032382 | A1 | 1/2008 |
| DE | 202012102760 | U1 | 12/2012 |
| DE | 10 2011 110207 | A1 | 2/2013 |
| DE | 20 2013 003741 | U1 | 4/2013 |
| DE | 202014101556 | U1 | 7/2014 |
| DE | 20 2014 103695 | U1 | 10/2014 |
| DE | 10 2013 110496 | A1 | 3/2015 |
| DE | 102013110496 | | 3/2015 |
| DE | 20 2015 005752 | U1 | 11/2016 |
| DE | 202015005752 | | 12/2016 |
| DE | 10 2016 112853 | A1 | 1/2018 |
| EP | 0555533 | A1 | 8/1993 |
| EP | 0997234 | A1 | 5/2000 |
| EP | 1238602 | A2 | 9/2002 |
| EP | 1516703 | A1 | 3/2005 |
| EP | 2020188 | A1 | 2/2009 |
| EP | 2703310 | A1 | 3/2014 |
| GB | 2459288 | | 10/2009 |
| WO | 01/25701 | | 4/2001 |
| WO | 02/11955 | A1 | 2/2002 |
| WO | 2011/000387 | A1 | 1/2011 |
| WO | 2011/032568 | | 3/2011 |
| WO | 2016/091570 | A1 | 6/2016 |
| WO | 2017/001083 | A1 | 1/2017 |
| WO | 2018/10857 | A1 | 1/2018 |
| WO | 2018/10858 | A1 | 1/2018 |

OTHER PUBLICATIONS

Result of Examination Report for DE 10 2016 112 853.8, filed Jul. 13, 2016.

International Search Report and Written Opinion for PCT/EP2017/058667 filed Apr. 11, 2017.

Result of Examination Report for DE 10 2016 112 854.6, filed Jul. 13, 2016.

International Search Report and Written Opinion for PCT/EP2017/058668 filed Apr. 11, 2017.

Result of Examination Report for DE 10 2016 112 855.4, filed Jul. 13, 2016.

English translation of International Preliminary Examination Report for PCTEP17/058667, filed Apr. 11, 2017.

English translation of International Preliminary Examination Report for PCT/EP17/058668, filed Apr. 11, 2017.

International Preliminary Examination Report with English translation of Written Opinion for PCT/EP17/058672, filed Apr. 11, 2017.

(56) References Cited

OTHER PUBLICATIONS

Office Action for U.S. Appl. No. 16/317,188, dated Mar. 18, 2020.
Result of examination report for German Application No. 10 2013 110 496.7, filed Sep. 23, 2013.
Result of examination report of German Application No. 10 2017 117 823.6, filed Aug. 7, 2017.
International Search Report, Written Opinion and International Preliminary Report on Patentability for PCT/EP2014/068714, filed Mar 26, 2015.
Youtube, XL-Boxx—The large power tool and transport case in the L-Boxx System posted by user Alexander Schweyer on Oct. 7, 2019 (https://ww.youtube.com/watch?v=A3gakVZn_y!) 2019.
Home Depot, 6"H × 14"W × 17.5"L Compartment Small Part Organizer first reviewed on Apr. 2, 2012 2012.
Office Action dated Jul. 20, 2020, for US Design Patent Application No. 29/679,432.
For U.S. Appl. No. 16/317,188: Resonse dated Jun. 1, 2020 Final Office Action dated Jun. 29, 2020.
Restriction Requirement Office Action dated May 19, 2020 for U.S. Appl. No. 16/317,234.
For U.S. Appl. No. 16/317,188: Reply to Office Action dated Sep. 14, 2020.
International Search Report, Written Opinion and International Preliminary Report on Patentability for PCT/EP2018/064742, filed Jun. 5, 2018.
Result of Examination Report for German Application No. 10 2017 128 493.1, filed Nov. 30, 2017.

STACKABLE SYSTEM CONTAINER

This application is the national stage (Rule 371) of international application No. PCT/EP2017/058672 filed Apr. 11, 2017.

FIELD OF THE INVENTION

The present invention relates to a stackable system container.

BACKGROUND OF THE INVENTION

DE 10 2013 110 496 discloses a stackable system container comprising a base part having an upward-facing open storage space and a cover part attached to the base part and bounding the storage space at the top. In addition, the system container also comprises two coupling elements that protrude upwardly beyond the top side of the system container and that are integrally formed in one piece with the base part and each comprise at least one latch for engaging the coupling device of an identical container disposed above. The coupling elements are furthermore disposed at oppositely lying ends of the top side of the system container and allow a plurality of such system containers to be centered and positioned one atop the other. After aligning a plurality of system containers with each other, these containers can be connected to each other by means of the coupling elements in a dimensionally stable, but detachable manner. This form- and force-fitting arrangement makes it possible for a plurality of system containers that are connected to each other to be comfortably carried with one hand. The disadvantage of this arrangement, however, is that the coupling elements entail a specific mounting system, thereby making modular use of the system container less feasible when stacking a plurality of different containers.

SUMMARY OF THE INVENTION

Thus, one aspect of the disclosure relates to a stackable system container that allows both structurally identical system containers to be stacked in a dimensionally stable and connected arrangement one atop the other and structurally different system containers to be modularly stacked one atop the other.

Further advanced modifications of the present invention are also disclosed.

The stackable system container according to the present invention is marked by the fact that the coupling elements are movably, especially pivotably, mounted to the top side of the system container in such a way that, in a pivoted-in position, they do not protrude beyond the top side of the system container. Thus, the coupling elements, depending on the specific case, can be pivoted between a pivoted-out and a pivoted-in position. In the protruding pivoted-out position, the coupling elements can interact with each other to retain a system container of the same type that is arranged on top of it, whereas in the pivoted-in position, the coupling elements do not prevent the arrangement of structurally different containers on the system container. Furthermore, in the latter case, the top side of the system container can also be conveniently used as a storage or work space.

In this context, system containers that are structurally identical or of the same type are defined as containers designed to interact with and retain at least two coupling elements of the system container, wherein, with respect to the dimensions or the presence of additional elements, different design layouts are covered as well.

According to a preferred embodiment, the coupling elements, in the pivoted-in position, can form a flat or nearly flat surface with the top side of the system container. This provides the system container with a stepless top side that is especially suitable for use as a storage or work space.

In an especially stable design layout, the coupling elements can preferably be pivoted relative to each other from the protruding position into the pivoted-in position in the direction of the center of the top side of the system container. If, in the protruding pivoted-out position, a structurally identical system container is disposed between the coupling flanges, the coupling elements are locked by the structurally identical system container, thereby preventing these coupling elements from being accidentally moved into the pivoted-in position. It is, however, also possible for the coupling elements to be arranged in such a way that they pivot laterally outwardly or downwardly from the protruding position into the pivoted-in position.

To further increase the stability of the coupling elements, these coupling elements, in the protruding position, can adjoin a stop of the system container. This causes the coupling elements, when in the protruding position, to be retained in a defined position and to be especially effectively shored up against any lateral forces.

The transmission of forces from the coupling elements into the system container can be especially effectively implemented in that the coupling elements in the protruding position engage the stop in the vertical direction from behind. This means that, in the vertical direction, a portion of a coupling element in the protruding position disposed above the stop engages the stop from below. As a result, any vertically upwardly acting forces, such as occur especially when a plurality of stacked system containers are transported, can be especially effectively counteracted. Thus, even relatively heavy system containers, connected to each other, can be transported as a unit by means of the grip on the system container positioned at the top.

To make the top side especially convenient for use as a storage and work space, the top side of the system container can comprise receiving depressions, into which the coupling elements can be pivoted. This result occurs to the greatest extent possible in a closed, stepless surface of the top side, which, in addition, is also easily cleanable.

To ensure positionally stable positioning of the coupling elements in the protruding position and/or the pivoted-in position, each coupling element can have at least one engagement means for the engagement of a coupling element in the upwardly protruding pivoted-out position and/or the pivoted-in position. Preferably, it is possible to override each engagement means by exerting a sufficient torque on the associated coupling element, which can be implemented, for example, by means of a spring-biased detent ball in mating detent grooves.

According to a preferred embodiment, the coupling elements can be attached to a cover part. It is, however, also possible to attach the coupling elements to the side walls of the base part.

To ensure the interlocking retaining connection of two system containers of this type, coupling devices can be disposed on the base part at least on the upper system container, which coupling devices are designed to interact with the coupling elements of the structurally identical system container disposed below. In the vertical direction, a retaining element of a coupling device can be disposed on the system container below a coupling element. If two upwardly protruding coupling elements are disposed at opposite ends of the top side of the system container, an engagement element of a coupling device can be disposed in the vertical direction, one below each of the coupling elements. Each engagement element is designed to interact with and retain coupling elements of a system container disposed below, which coupling elements are structurally identical to the coupling elements of this system container, and more particularly to engage with hook-shaped elements in a recess of the respective coupling element.

In addition, the cover part is preferably pivotably attached to the base part. This provides easy access to the storage space in the base part and, at the same time, an especially stable connection between the cover part and the base part.

BRIEF DESCRIPTION OF THE DRAWINGS

Further special features and advantages of the invention follow from the description of preferred practical examples below with reference to the drawings. The drawings show.

DETAILED DESCRIPTION OF THE INVENTION

Figure 1:
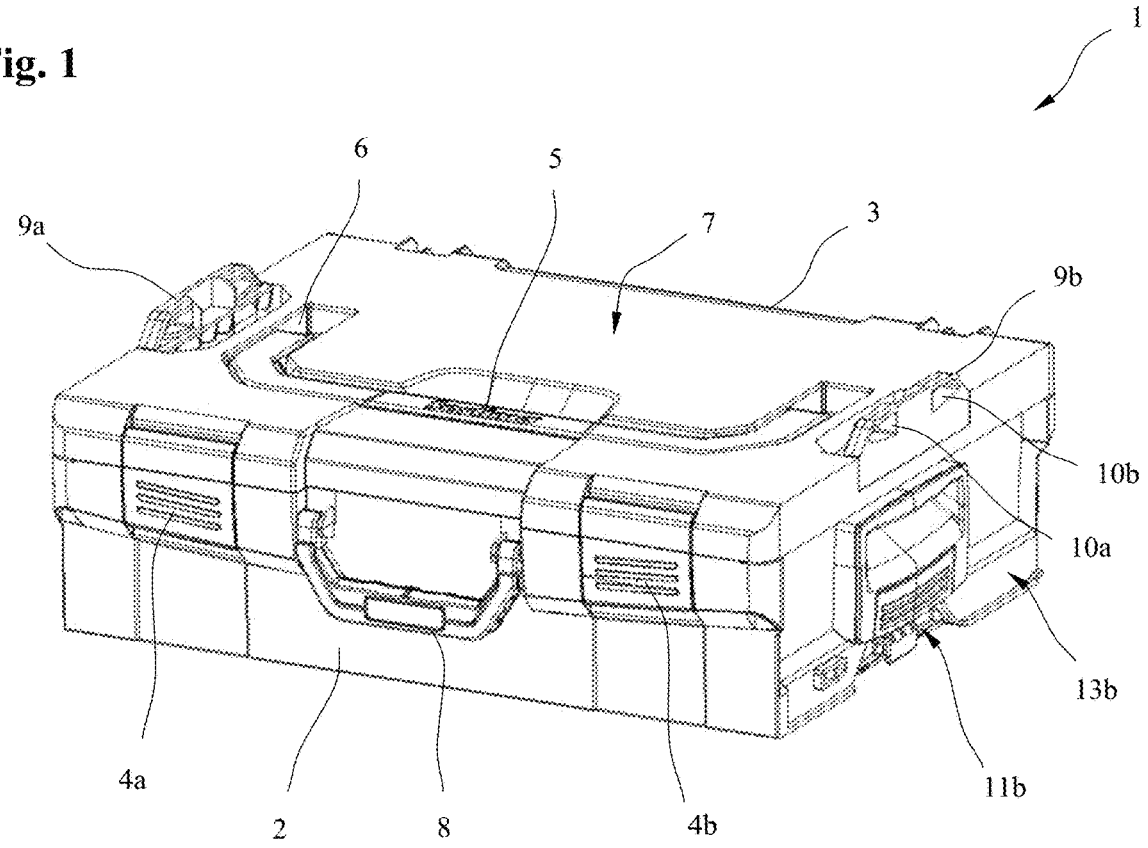
FIG. 1 a perspective representation of a stackable system container comprising upwardly protruding coupling elements.

FIG. 1 shows a perspective representation of a stackable system container 1. The system container 1 comprises a base part 2 and a cover part 3 pivotably attached to the base part 2. The base part 2 has an upward-facing open storage space (not shown) that is bounded on top by the cover part 3. The cover part 3 is pivotably mounted on the base part via a swivel joint disposed on the rearward edge of the cover part. To be able to detachably fasten the cover part 3 to the base part 2 and thereby to securely close the enclosed storage space, two locking means 4*a*, 4*b* are provided on the front side of the system container 1, which locking means are hinged to the cover part 3 and, in the closed position of the system container 1 as shown, engagingly interact with the base part 2.

The system container 1 can be used, for example, by craftsmen to transport and store tools and working media. To this end, the base part 2 preferably comprises a bottom section and four side walls that bound an upward-facing open storage space. It is, however, also possible for the base part to be configured like that of the container disclosed in EP 2 703 310. In this context, reference is made to EP 2 703 310, the entire content of which is hereby fully incorporated by reference in the present application.

For easy transport of the system container 1, a retaining bracket 5 is mounted on the cover part 3 so as to be able to pivot between an upwardly protruding position and a pivoted-in position. In the pivoted-in position, the retaining bracket 5 is disposed in such a way that it is recessed in a grip depression 6 of the cover part 3 so that the retaining bracket 5, together with the cover part 3, forms a stepless flat top side 7 of the system container 1. In addition, a handle grip 8 is pivotably attached to a front side of the base part 2, which handle grip allows the system container 1 to be grasped and transported.

The cover part 3 also comprises two coupling elements 9*a*, 9*b* in the form of rib-like engaging members that protrude upwardly beyond the top side 7 of the system container 1 and are disposed at opposite ends of the top side 7. The coupling elements 9*a*, 9*b* have each two recesses 10*a*, 10*b*, which are designed for the engagement of coupling devices of a system container of the same type that is disposed above (not shown). The coupling devices of the system container disposed above (not shown) are designed to be structurally identical to the coupling devices 11*a*, 11*b* on the system container 1, the coupling device 11*b* of which is shown in FIG. 1. The coupling device 11*b* is disposed on the side of the base part 2 and below the coupling element 9*b*, and the coupling device 11*a* (not shown in FIG. 1) on the oppositely lying side of the base part 2 is similarly disposed below the coupling element 9*a*.

The recesses 10*a*, 10*b* are configured in the form of pockets that extend horizontally through the coupling elements 9*a*, 9*b* shown in the drawing and that are designed to be engaged and retained in the vertical direction from behind by the associated coupling device of the system container disposed above (not shown). With regard to the other features of the coupling devices and coupling elements, reference is made to EP 2 703 310, the entire content of which is hereby fully incorporated by reference in the present application.

Figure 2:
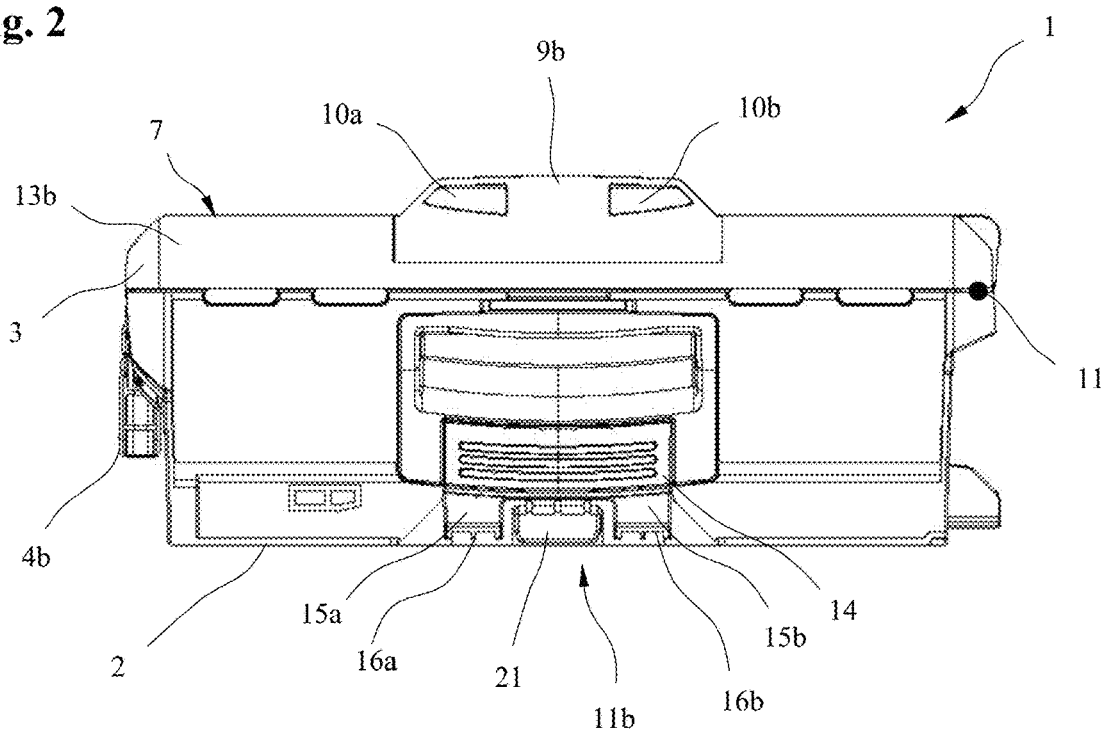
FIG. 2 a lateral view of the stackable system container of FIG. 1.

FIG. 2 shows a lateral view of the stackable system container of FIG. 1. As the lateral view indicates, the base part 2 and the cover part 3 are pivotably connected to each other via the diagrammatically sketched swivel joint 12 and detachably held in place relative to each other by the locking device 4*b* shown in the drawing.

In the protruding position shown, the coupling element 9*b* forms a stepless flat lateral surface 13*b* with the cover part 3, which saves space and provides a visually pleasing appearance. Similarly, the coupling element 9*a* (not shown in the drawing) on the opposite side forms a flat lateral surface 13*a* with the cover part 3.

The coupling device 11*b* comprises a spring-biased retention component 14 that is pivotably attached to a side wall of the base part 2. Disposed on the retention component 14 are two downwardly protruding engagement elements 15*a*, 15*b*, each of which has a hook-shaped element 16*a*, 16*b* at its lower end. In the vertical direction, the hook-shaped elements 16*a*, 16*b* are vertically disposed exactly below the recesses 10*a* and 10*b* such that, when two such system containers are stacked one atop the other, the hook-shaped elements 16*a*, 16*b* are able to engage in the recesses 10*a*, 10*b* of the coupling element disposed below, thereby holding it in place.

By exerting pressure on the retention component 14 and on the oppositely lying unnumbered retention component, which is a mirror image thereof, this retention component can be moved about a horizontal axis from the spring-loaded locked position shown in the drawing into an open position. This causes the hook-shaped elements 16*a*, 16*b* to be moved in the horizontal direction and to be disengaged from the recesses 10*a*, 10*b* of the coupling element of a second system container disposed below, thereby disconnecting the retaining connection between the system containers. Suitable slanted sliding surfaces on the engagement elements 9*a*, 9*b* and/or the hook-shaped elements 16*a*, 16*b* make it possible, by simply pushing two system containers against each other, to move the hook-shaped elements 16*a*, 16*b* and thus the retention component 14 in the vertical direction, which causes the hook-shaped elements 16*a*, 16*b* to automatically engage in the recesses 10*a*, 10*b* and the two system containers stacked one atop the other to be automatically connected to each other.

Figure 3:
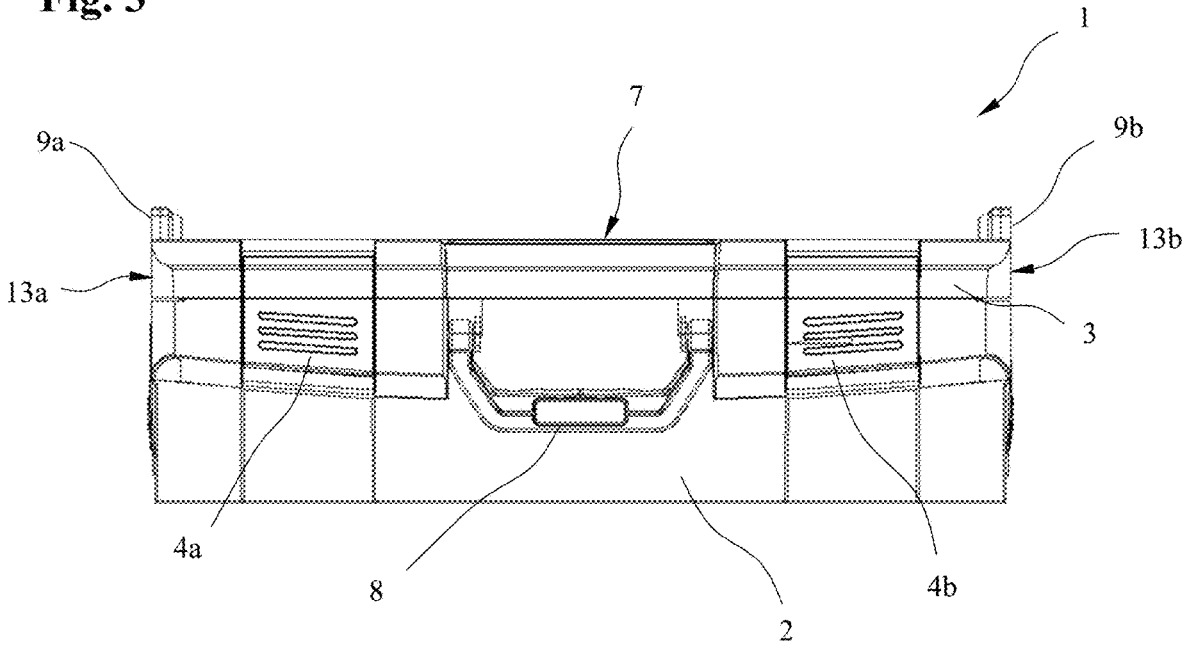
FIG. 3 a front view of the stackable system container of FIG. 1.

FIG. 3 shows a front view of the stackable system container of FIG. 1. As the drawing indicates, the top side 7 of the system container 1 has a flat stepless surface, on each lateral end of which only the coupling elements 9*a*, 9*b* protrude in the position shown. The retaining bracket 5 shown in FIG. 1 is recessed in the grip depression 6 in the top side 7 such that the retaining bracket 5 forms a flat surface with the top side 7.

Figure 4:
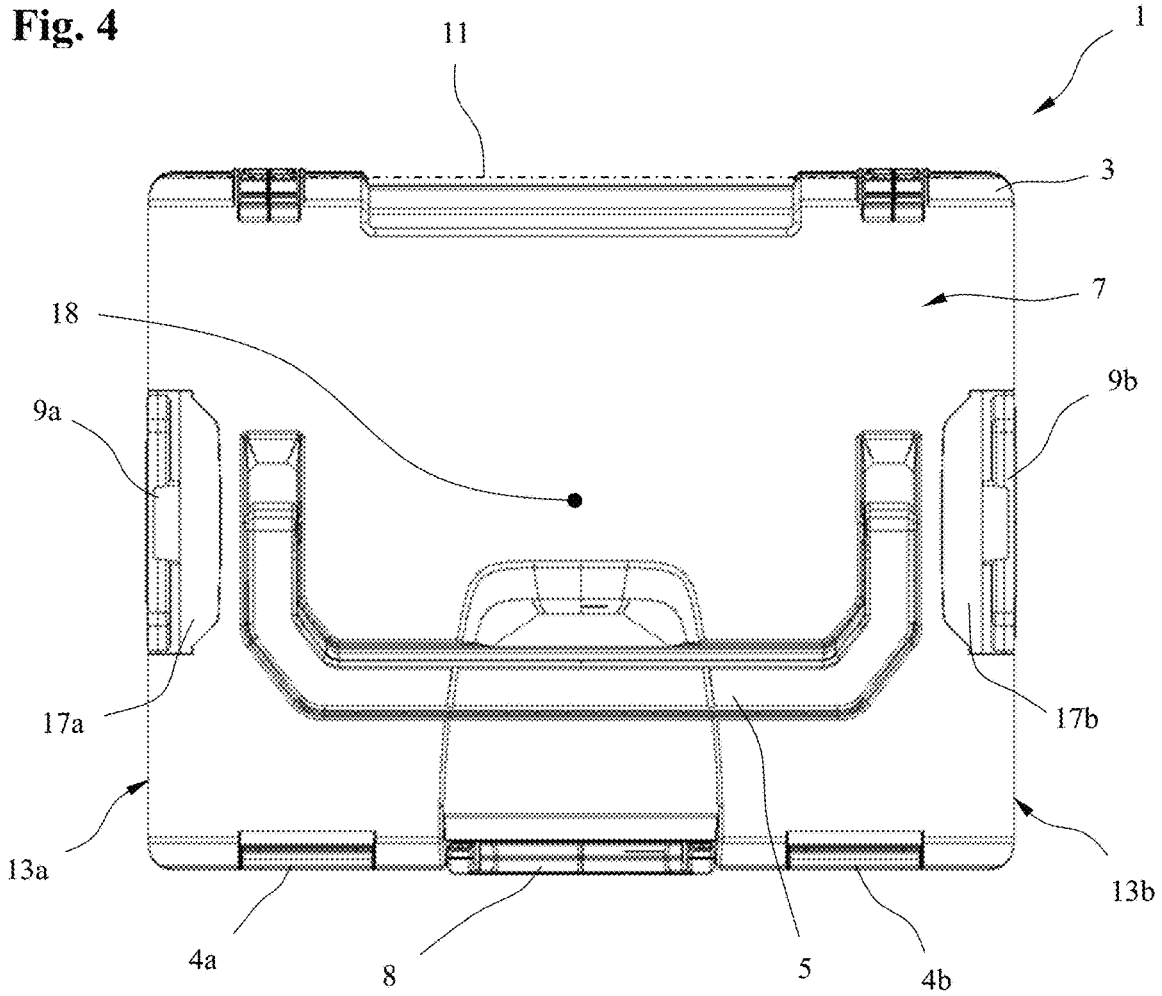
FIG. 4 a top view of the stackable system container of FIG. 1.

FIG. 4 shows a top view of the stackable system container 1 of FIG. 1. As the drawing indicates, the top side 7 in the cover part 3 comprises receiving depressions 17*a*, 17*b* in which the coupling elements 9*a* and 9*b* are disposed. The receiving depressions 17*a*, 17*b* are disposed at oppositely lying ends of the top side 7 of the system container 1 and open each one toward one of the lateral surfaces 13*a*, 13*b* of the cover part 3. In these receiving depressions 17*a*, 17*b*, the coupling elements 9*a*, 9*b* are pivotably attached to the top side 7 of the system container 1 in such a manner that they can be pivoted from the protruding position shown in the drawing in the direction of a diagrammatically sketched center 18 of the top side 7 of the system container 1.

To lock the coupling elements 9*a*, 9*b* in the pivoted-in position and/or the protruding position, an engagement device known in the art can be disposed between the coupling elements 9*a*, 9*b* and the receiving depressions 17*a*, 17*b*. This device can be, for example, a spring-biased detent ball in a component, which detent ball is guided in a guide path having engagement pockets at one end or at both ends in the oppositely lying component. Because of the spring bias, it is possible to override the locking means by exerting a sufficient torque on the respective coupling element and to pivot the coupling element from the protruding position into the pivoted-in position.

Figure 5:
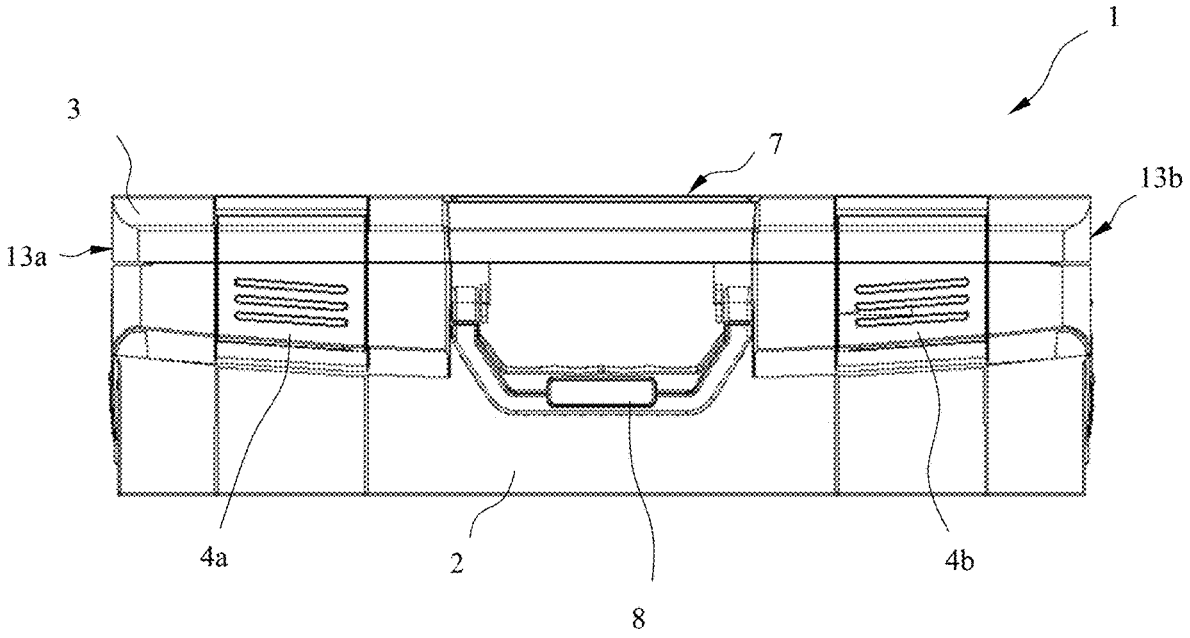
FIG. 5 a front view of a stackable system container with the coupling elements in a pivoted-in position.

FIG. 5 shows the system container 1 wherein, in contrast to the preceding figures, the coupling elements 9*a*, 9*b* are in the pivoted-in position. In the pivoted-in position, the coupling elements 9*a*, 9*b* are completely integrated in the receiving depressions 17*a*, 17*b* and in this position do not protrude beyond the top side 7 of the system container 1. The coupling elements are designed to pivotably attach to the cover part 3 in such a manner that, when in the pivoted-in position, they form a flat stepless surface with the top side 7 of the system container 1, which result occurs to the greatest extent possible in a closed surface for the storage of additional system containers of any type as well as in a work space for processing workpieces.

Figure 6:
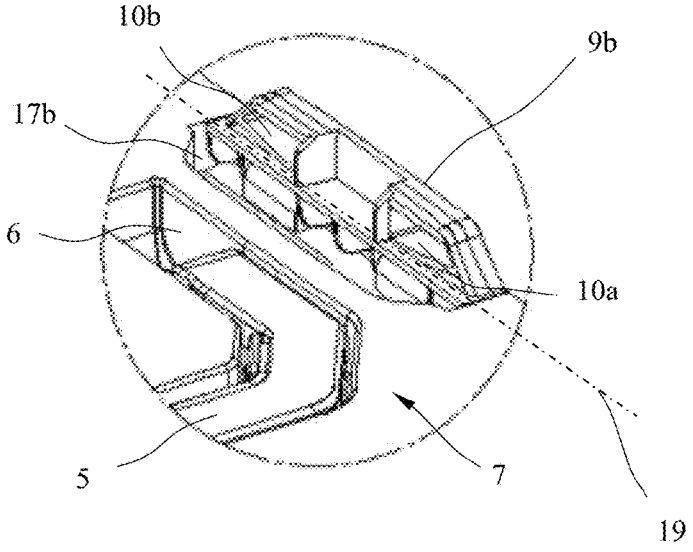
FIG. 6 a perspective detail view of a coupling element in the protruding position.

FIG. 6 shows a perspective detail view of the coupling element 9*b* in the protruding position. The coupling element 9*b* is designed as a mirror image of the oppositely lying coupling element 9*a* and is pivotably disposed about the diagrammatically sketched pivot axis 19. Disposed between the recesses 10*a*, 10*b*, which extend in the horizontal direction and at right angles to the pivot axis 19, is a positioner receiving means 20 in the form of an upward-facing open pocket that serves to receive a positioning pin 21 as shown in FIG. 2, which positioning pin is rigidly disposed on the base part 2. The positioning pin 21 and the positioner receiving means 20 facilitate the easy positioning of and connection between two system containers 1 of the same type that are disposed one atop the other.

As FIG. 6 indicates, the horizontal contour of the receiving depression 17*b* as well as that of the receiving depression 17*a*, which is configured as a mirror image thereof, is designed to correspond to the vertical contour of the coupling element 9*b* in the protruding position shown in the drawing. The effect of this is that the coupling elements 9*a*, 9*b* in the pivoted-in position close the receiving depressions 17*a*, 17*b* to the greatest extent possible free from gaps in order to prevent working materials or dirt from penetrating when the top side 7 is used as a work space.

Figure 7:
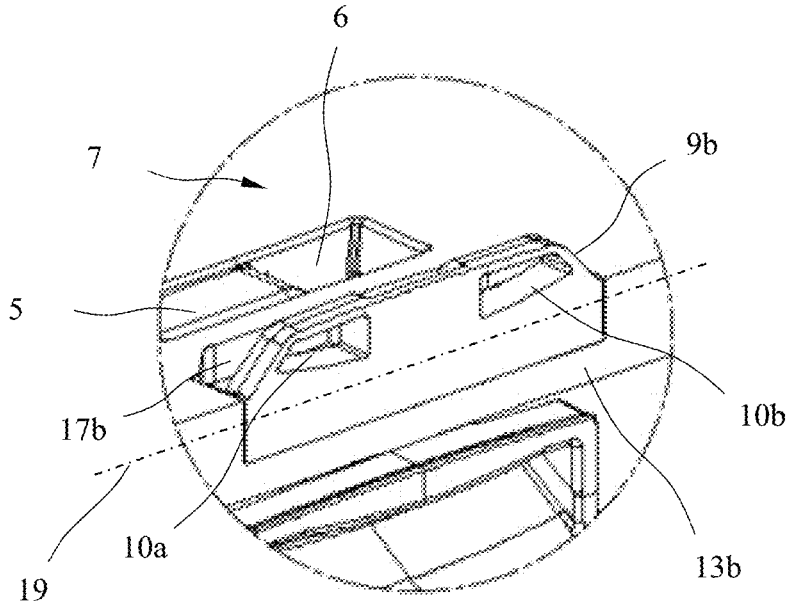
FIG. 7 a second perspective detail view of the coupling element of FIG. 6.

FIG. 7 shows a second perspective detail view of the coupling element 9*b* of FIG. 6. As the drawing indicates, the coupling element 9*b* as well as the complementarily shaped oppositely lying coupling element 9*a* is disposed in the receiving depression 17*b* in such a way that this coupling element, in the protruding position shown in the drawing, is flush with the lateral surface 13*b* of the cover part 3. The pivot axis 19 is oriented parallel relative to the top side 7 and the lateral surface 13*b*.

Figure 8:
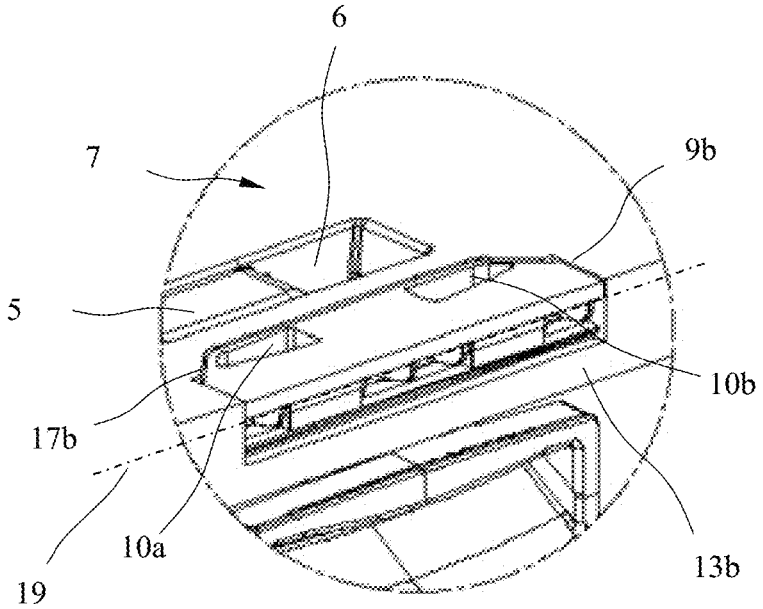
FIG. 8 a perspective detail view of a coupling element in the pivoted-in position.

FIG. 8 shows a perspective detail view of the coupling element 9*b* in the pivoted-in position in which the coupling element 9*b* is flush with the top side 7 of the system container 1. As can also be seen, in this position, the coupling element 9*b* upwardly closes the receiving depression 17*b* to the greatest extent possible free from gaps. In addition, the coupling element 9*b* here is designed to be flush with the lateral surface 13*b* of the cover part 3, but in contrast to the configuration shown in the drawing, the coupling element 9*b* can also laterally close the receiving depression 17*b* to the greatest extent possible free from gaps with respect to the lateral surface 13*b*.

Figure 9:
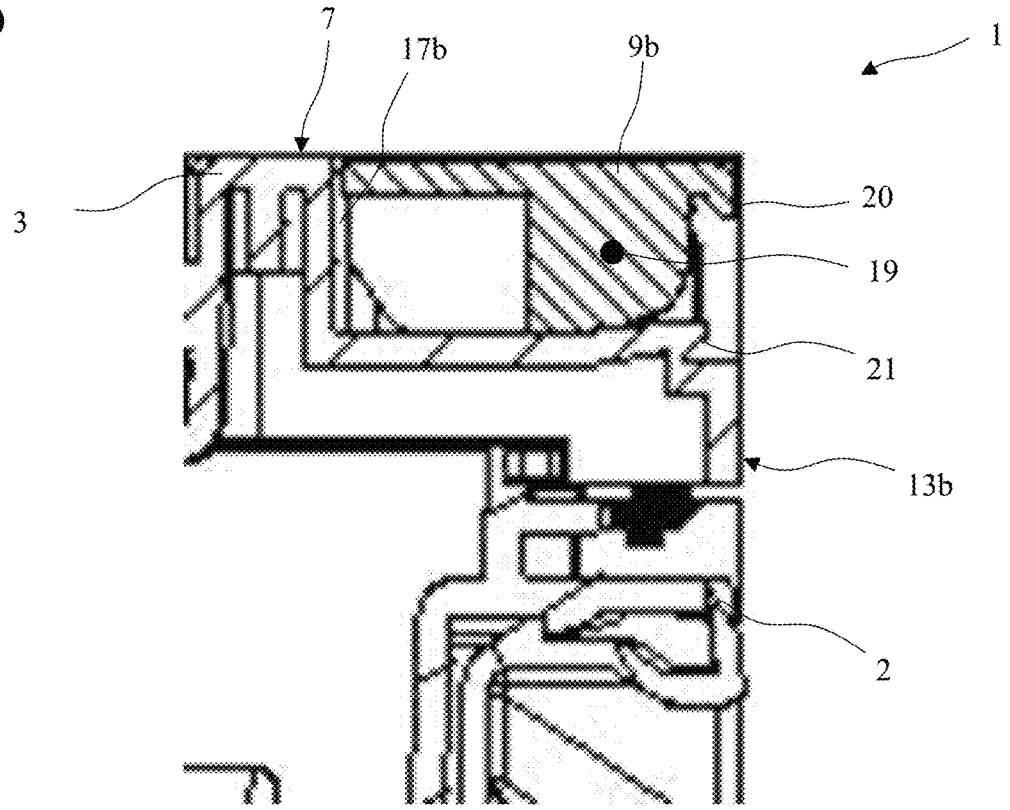
FIG. 9 a sectional view through a system container in the area of a coupling element in the pivoted-in position.

FIG. 9 shows a cross-section through a system container 1 in the area of the coupling element 9*b*. The coupling element 9*b* here is in the pivoted-in position and closes the receiving depression 17*b* upwardly flush with the top side 7 of the system container 1. In addition, the coupling element 9*b* is also flush with the lateral surface 13*b* and especially laterally does not protrude beyond that surface. Provided on the coupling element 9*b* at a distance from the pivot axis 19 is a projecting part 22 that is designed to correspond to a stop 23 disposed in the receiving depression 17*b*. The projecting part 22 has a wedge-shaped cross-section, and the stop 23 has a matching wedge-shaped groove. It is, however, also possible to dispose the stop 23 for the projecting part 22 on the cover part 3 outside the receiving depression 17*b* and/or to configure it differently. In addition, by providing suitable pressure points or recesses for fingers, it is possible to facilitate the swiveling in and out of the coupling elements 9*a*, 9*b*.

Figure 10:
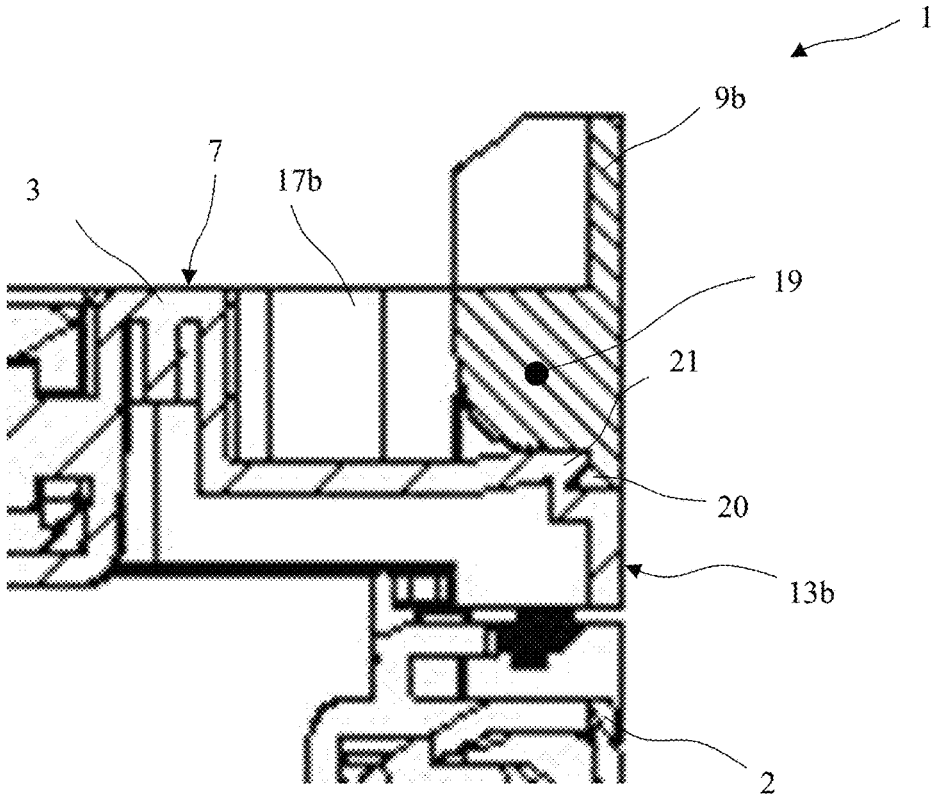
FIG. 10 a sectional view of a system container in the area of a coupling element in the protruding position.

FIG. 10 shows a cross-section through the system container 1 of FIG. 9, wherein the coupling element 9*b* is in a position pivoted by 90° and protruding vertically upwardly beyond the top side 7. As the drawing indicates, the projecting part 22 sits close to the stop 23 and, in addition, engages the stop from behind. In a variation of the wedge-shaped groove shown in the drawing, the stop 23 can also have a rectangular cross-section that is engaged from behind by a corresponding projecting part 22. Because the coupling element 9*b* disposed above the stop 23 engages the stop 23 with the projecting part 22 in the vertical direction from below, vertical tensile forces on the coupling element 9*b* can be introduced to special advantage into the cover part 3.

Because the arrangement and design of the coupling elements 9*a*, 9*b* mirror the arrangement and design of the receiving depressions 17*a*, 17*b*, the configuration described with reference to the figures for one side also applies to the oppositely lying coupling element having the receiving depression associated therewith. Similarly, the coupling devices 11*a*, 11*b* on the base part 2 are also designed as mirror images of each other so that reference is again made to the configuration described.

In a variation of the configuration shown in the drawing, it is also possible to attach the coupling elements 9*a*, 9*b* to oppositely lying side walls of the base part 2. The receiving depressions 17*a*, 17*b* can again be completely integrated in the side walls or extend at least partially within the cover part 3.

LIST OF REFERENCE CHARACTERS

1 Stackable system container
2 Base part
3 Cover part
4*a*, 4*b* Locking device
5 Retaining bracket
6 Grip depression
7 Top side of the system container
8 Handle grip
9*a*, 9*b* Coupling element
10*a*, 10*b* Recess
11*a*, 11*b* Coupling device
12 Swivel joint
13*a*, 13*b* Lateral surface
14 Retention component
15*a*, 15*b* Engagement element
16*a*, 16*b* Hook-shaped element
17*a*, 17*b* Receiving depression
18 Center of the top side
19 Pivot axis
20 Positioner receiving means
21 Positioning pin
22 Projecting part
23 Stop

The invention claimed is:

1. A stackable system container comprising:

a base part including at least two cavities in a bottom side, the cavities each including a latch portion;

a cover part fastened to the base part to position the cover at a top side of the system container;

at least two coupling elements each:

(a) disposed at opposite ends of the top side of the system container, (b) pivotably attached at the top side of the system container to pivot between a pivoted-in position in which the coupling element does not protrude beyond the top side of the system container, and a pivoted-out position in which the coupling element protrudes upwardly away from the top side of the system container; and (c) having a plurality of latch recesses each sized and dimensioned to receive a and latch to a latch portion of a cavity of a bottom side of a second system container when a second system container is disposed above the top side of the system container to thereby releaseably secure the system container to the second system container.

2. The system container of claim 1, wherein the coupling elements, in the pivoted-in position, form a flat surface with the top side of the system container.

3. The system container of claim 1, wherein the coupling elements are pivotable from the pivoted-out position into the pivoted-in position by moving an end of the coupling element in a direction towards a center of the top side of the system container.

4. The system container of claim 1, wherein the coupling elements, in the pivoted-out position, engage a stop of the system container.

5. The system container of claim 4, wherein the coupling elements, when pivoted into the pivoted-out position, engage the stop from the vertical direction and into a mutual side engagement that prevents disengagement of the system container and a second system container in a vertical direction.

6. The system container of claim 1, further including at least two depressions disposed on the top side of the system container into each of which a coupling element can be pivoted.

7. The system container of claim 1, further including, for each coupling element, a retaining element formed between the cover and the coupling element sized and dimensioned to releasably retain the coupling element in either the pivoted-out or pivoted-in position.

8. The system container of claim 7, wherein a retaining force of each retaining element can be overcome by exerting a sufficient torque on the respective coupling element.

9. The system container of claim 1, wherein the coupling elements are each pivotally attached to a cover part within a depression in the cover.

10. The system container of claim 1, wherein the coupling elements are disposed on the side walls of the base part.

11. The system container of claim 1, wherein the cover part is pivotably attached to the base part.

12. The system container of claim 1, wherein the latch portion of a cavity forms a hook.

13. The system container of claim 12, further including a movable latch release connected to each hook, the latch release operative to move the latch hook out of engagement with the latch recess.

14. The system container of claim 1, the at least two coupling elements including a first coupling element engaging with a stop surface of the cover to prevent lateral movement of the first coupling element in a first direction, and the second coupling element engaging with a stop surface of the cover to prevent lateral movement of the second coupling element in a second direction opposite to the first direction, the first and second coupling elements thereby engageable with the second container to prevent lateral movement of the second container in either the first or second direction.

15. A container, comprising:

a base having a bottom side having first and second cavities each including a base latch portion;

a cover attached to the base and having first and second depressions each sized and dimensioned to receive first and second coupling elements, respectively, each of the first and second coupling elements:

(a) having at least one coupling latch portion sized and dimensioned to engage a base latch portion of a second container when a second container is disposed above the top side of the container, (b) disposed proximate opposed side surfaces of the cover;

(c) pivotably attached to the cover to pivot between a pivoted-in position in which the coupling element lies within a depression and does not protrude away from a top surface of the cover, and a pivoted-out position in which the coupling element protrudes away from the top surface of the cover, and (d) having a latch portion mateable with the latch portion of the base part of a depression in a bottom side of a second container when the second container is disposed above the top side of the container, to thereby releaseably secure the container to the second container; and the first coupling element engaging with a stop surface of the cover to prevent lateral movement of the first coupling element in a first direction, and the second coupling element engaging with a stop surface of the cover to prevent lateral movement of the second coupling element in a second direction opposite to the first direction, the first and second coupling elements thereby engageable with the second container to prevent lateral movement of the second container in either the first or second direction.

16. The container of claim 15, wherein the base latch portion is connected to a handle movable to disengage the base latch portion from the coupling latch portion.

17. The container of claim 15, the coupling latch portion formed as an aperture and the base latch portion formed as a hook engageable into the aperture of the coupling latch portion.

18. The container of claim 15, the stop surfaces of the cover associated with the first and second coupling elements, respectively, each positioned to prevent movement of the respective coupling element lateral to a side surface of the container.

19. A container, comprising:

a base having a bottom side having first and second cavities each associated with a plurality of base latch portions;

a cover attached to the base and having first and second depressions each sized and dimensioned to receive first and second coupling elements, respectively, each of the first and second coupling elements:

(a) having at least one coupling latch portion sized and dimensioned to engage a base latch portion of a second container when a second container is disposed above the top side of the container, (b) disposed proximate opposed side surfaces of the cover;

(c) pivotably attached to the cover to pivot between a pivoted-in position in which the coupling element lies within a depression and does not protrude away from a top surface of the cover, and a pivoted-out position in which the coupling element protrudes away from the top surface of the cover, and (d) having a latch portion including a plurality of latch openings each mateable with a base latch portion of a second container when the second container is disposed above the top side of the container, to thereby releaseably secure the container to the second container; and the first coupling element engaging with a first stop surface of the cover to prevent lateral movement of the first coupling element in a first direction, and the second coupling element engaging with a second stop surface of the cover to prevent lateral movement of the second coupling element in a second direction opposite to the first direction, the first and second stop surfaces each positioned to block pivoting of the respective coupling element away from and beyond an outer side surface of the container, the first and second coupling elements thereby engageable with the second container to prevent lateral movement of the second container in either the first or second direction and out of a lateral alignment with the container.

* * * * *